US006292636B1

(12) United States Patent
Kwon

(10) Patent No.: US 6,292,636 B1
(45) Date of Patent: Sep. 18, 2001

(54) PAPER DETECTING APPARATUS OF ELECTROPHOTOGRAPHIC PROCESSOR

(75) Inventor: Joong-Gi Kwon, Kunpo (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/572,889

(22) Filed: May 18, 2000

(51) Int. Cl.[7] ..... G03G 15/00; G03G 21/00

(52) U.S. Cl. ..... 399/16; 271/10.03; 271/265.1; 399/23; 400/708

(58) Field of Search ..... 399/16, 18, 21, 399/23, 388; 271/3.13, 10.02, 10.03, 258.01, 265.01, 152, 153; 400/708

(56) References Cited

U.S. PATENT DOCUMENTS 5,897,112 * 4/1999 Kwag ..... 399/23 X 6,152,631 * 11/2000 Park ..... 400/708

* cited by examiner

*Primary Examiner*—Sophia S. Chen
(74) *Attorney, Agent, or Firm*—Robert E. Bushnell, Esq.

(57) ABSTRACT

A paper detecting apparatus of an electrophotographic processor allows reduction of product cost by enabling total sensing of paper loading and paper transporting in a paper cassette with only one sensor. The paper detecting apparatus inter-actuates the second actuator for turning the switch on and off with the first actuator to which displacement is produced depending on paper loading in the paper cassette, and produces a displacement of the second actuator depending on the actuation of the first actuator. It also produces a displacement of the second actuator depending on the paper transport, and is thereby able to sense both the paper loading state within the paper cassette and the paper transport state within the picture processor according to the on/off state of the switch. Accordingly, both paper loading within the paper cassette and paper transporting within the electrophotographic processor can be sensed through the use of only one sensor. Therefore, product cost reduction may be achieved.

14 Claims, 3 Drawing Sheets

PAPER DETECTING APPARATUS OF ELECTROPHOTOGRAPHIC PROCESSOR

BACKGROUND OF THE INVENTION

1. Field of the Invention

This invention relates to a paper detecting apparatus of an electrophotographic processor which saves product cost by enabling total sensing of paper loading and paper transporting in a paper cassette with one sensor.

2. Prior Art

Generally, electrophotographic processors, such as printers, facsimiles, and photocopiers, which use normal recording paper, are provided with a paper supply cassette 110 (FIG. 1) which is provided with a paper support 112, one side thereof being resiliently supported by a compressed coil spring 111, and a finger (not shown) which separates paper into single sheets.

The topmost paper among the paper loaded on the paper support 112 is picked up by the frictional force of a pick-up roller 120, and the paper picked up is transported to the developer 140 by a transport roller 130 and numerous idle rollers 131–133, and while the paper is passing through the developer, an image is produced by a photosensitive drum 141, picture convey roller 142, and laser scanning unit 150.

Then, toner is fixated by a heating roller 161 and a compression roller 162 and the image is completely produced on the paper, and the paper with the image produced thereon is ejected to the outside by being passed through a transport roller 170 and a paper ejection roller 180.

The paper usually starts off at point A and is ejected at point D. However, if the cover 190 is open, the paper does not pass through the paper ejection roller 180 and instead starts at point A and is ejected at point C.

On the other hand, in an electrophotographic processor, independently from the automatic paper transporting structure composed as the above, a paper tray (not shown) installed in a removable manner and used for manual paper supply may be employed.

Therefore, during manual paper supply, the paper is supplied at point B and is ejected at point C or D.

The path between the transport roller 130 and the other transport roller 170 is a shared paper transport path.

In addition, in an electrophotographic processor, there are provided various sensors for sensing respective sections, and an exemplary sensor among these sensors is the paper detecting apparatus. As the paper detecting apparatus, there are the sensor for sensing whether paper has been loaded within the paper cassette, and the sensor for sensing the paper transport state.

Here, the sensor for sensing the paper loading senses whether there is paper loaded on the paper support and outputs this data to a controller with a predetermined signal, and if it is determined that there is no paper loaded, the controller outputs error and warning messages so that the user may provide paper.

The sensor for sensing paper transport state senses whether the picked up paper has reached the printing location and senses the initiation time (position) of printing, and if the picked up paper is unable to reach the sensor location within a certain amount of time after paper pickup, it recognizes this as JAM 0, and if the picked up paper is unable to pass through the sensor location within a certain amount of time, it also recognizes this as JAM 1.

However, according to the conventional paper detecting apparatus composed as the above, because the sensor for sensing paper loading and the sensor for sensing paper transport state are provided separately, there is an undesirable problem in the aspect of economic inefficiency of the product.

SUMMARY OF THE INVENTION

This invention is disclosed to resolve the above mentioned problems, wherein the object thereof is to provide a paper detecting apparatus of an electrophotographic processor which enables product cost reduction by sensing whether the paper is loaded within the paper cassette and the paper transport state with only one sensor required.

To achieve the object, the present invention is characterized in that it includes: a first actuator in which one end thereof is hinged to a hinge section to produce a displacement depending on whether the paper loaded on the paper support is loaded or not; an L shaped second actuator in which the center thereof is hinged to the hinge section to produce a displacement depending on the paper transport state; a sensing section which outputs different signals according to the abutment state with the end of the second actuator; an elastic section which controls the abutment state of the sensing section and the second actuator according to the paper loading state, and which connects the first actuator and the second actuator such that the abutment between the end of the second actuator and the sensing section is released during paper transport; a timer which measures the time periods of the signals inputted from the sensing section; and a control unit which determines paper loading state and paper transport state according to the output value of the timer and the sensing section.

According to a preferable feature of this invention, the sensing section is at an off position at normal times, and is provided with an aperture into which one end of the first actuator is inserted when paper is not loaded in the paper support.

According to another preferable feature of this invention, the control unit senses paper according to the steps of: determining paper loading state by checking whether the sensor switch is on or not; determining whether a print command has been inputted or not; picking up the paper; counting a first set time; determining JAM 0 by checking whether the sensor switch is off or not; counting a second set time; and indicating JAM 1 or a paper supply message by checking whether the sensor switch is on or not.

Alternatively, the timer and control unit may be embodied through the controller of the electrophotographic processor.

The paper detecting apparatus having these features according to the present invention inter-actuates the second actuator for turning the switch on and off with the first actuator to which displacement is produced depending on paper loading in the paper cassette and produces a displacement of the second actuator depending on the actuation of the first actuator, and also produces a displacement of the second actuator depending on the paper transport and thereby is able to sense both the paper loading state within the paper cassette and the paper transport state within the electrophotographic processor according to the on/off state of the switch.

BRIEF DESCRIPTION OF THE DRAWINGS

The objects and features of this invention will become apparent by the detailed descriptions of the preferred embodiment with reference to the annexed drawings.

FIGS. 3 and 4 show the operating state of the paper detecting apparatus according to the present invention, wherein FIG. 3 shows the sensing state of paper transport;

FIG. 4 shows the sensing state of paper loading; and

DESCRIPTION OF THE PREFERRED EMBODIMENT

The preferred embodiment of this invention is described in detail hereinbelow with reference to the annexed drawings.

Figure 1:
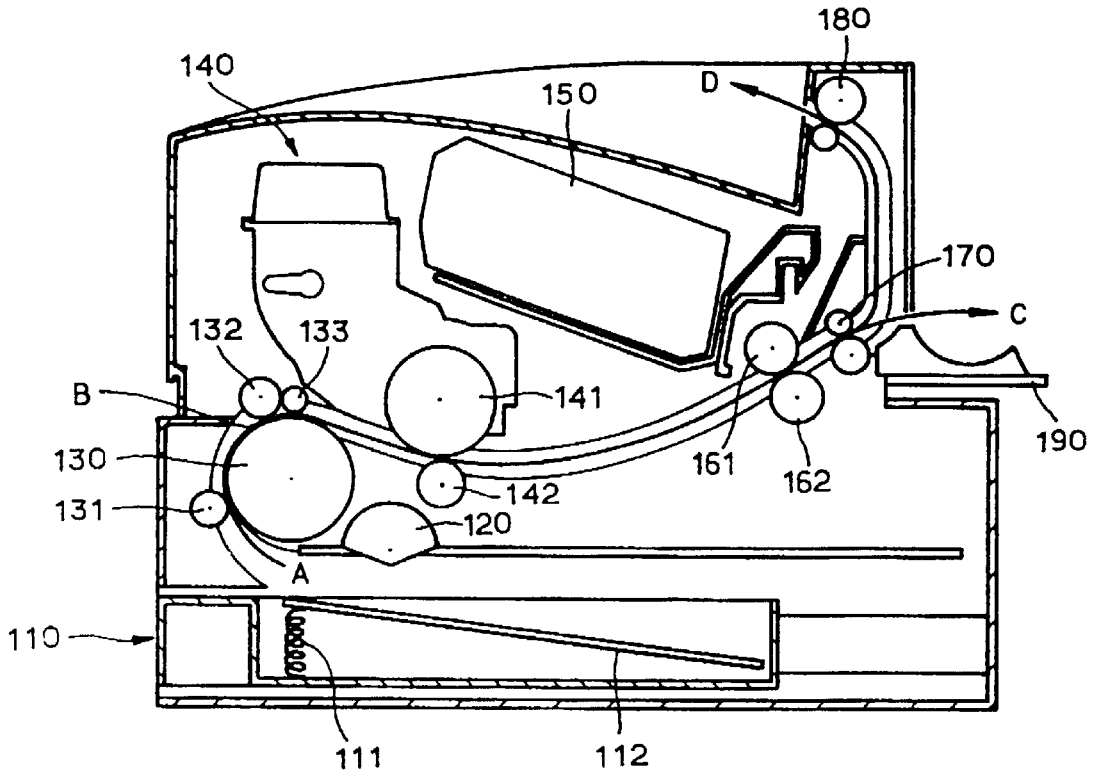
FIG. 1 (Prior Art)
FIG. 1 is a structural diagram of a conventional electrophotographic processor.
Figure 2:
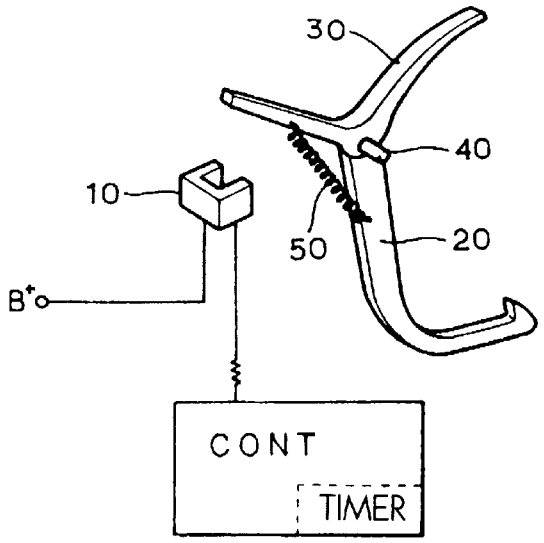
FIG. 2 is a structural diagram of a paper detecting apparatus according to the present invention.
Figure 3:
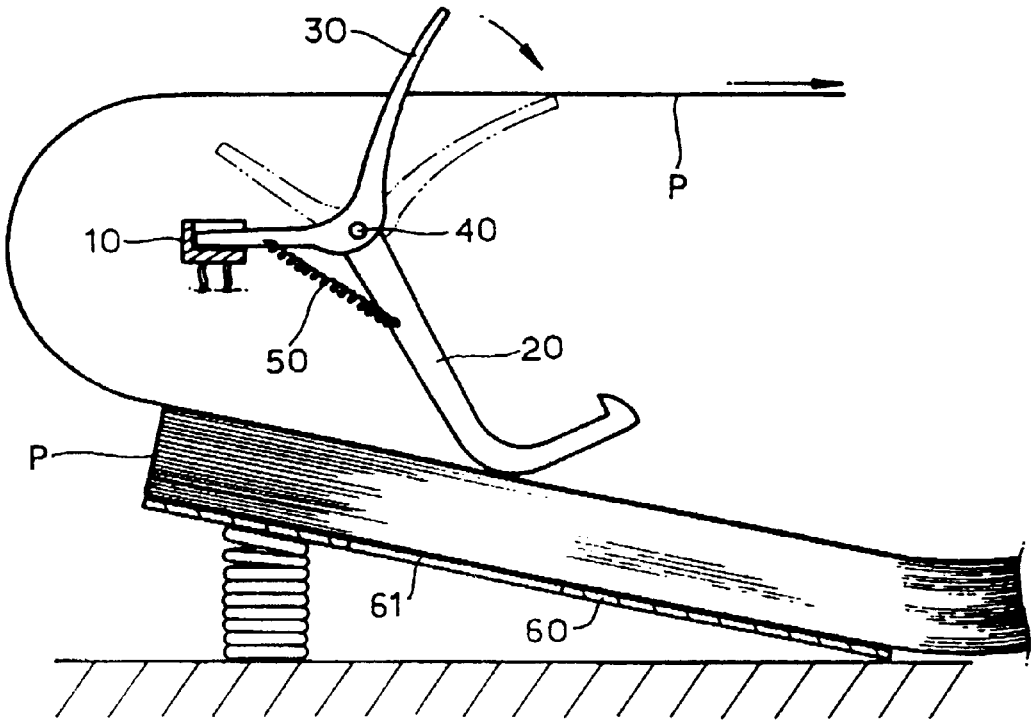
Figure 4:
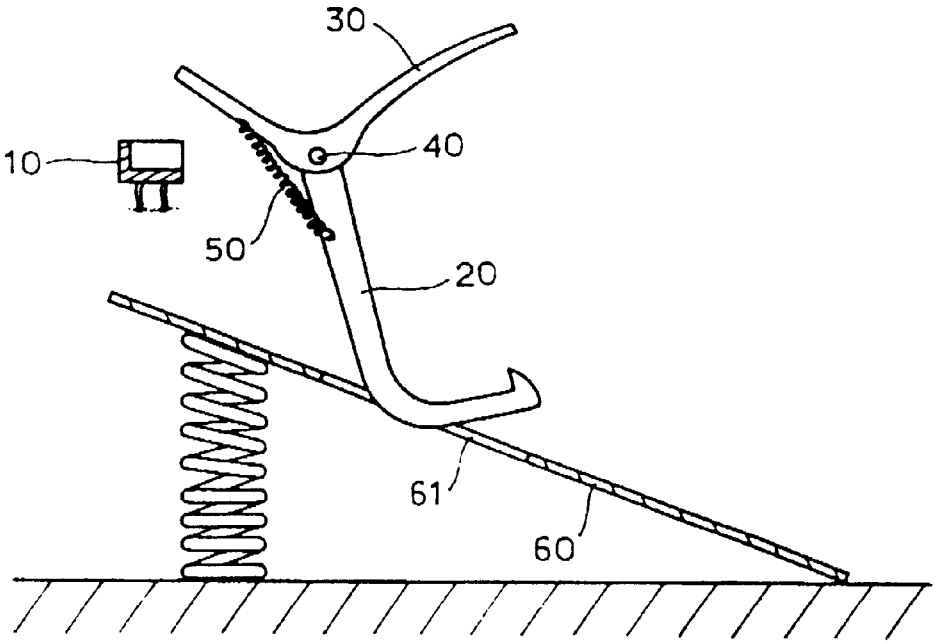
Figure 5:
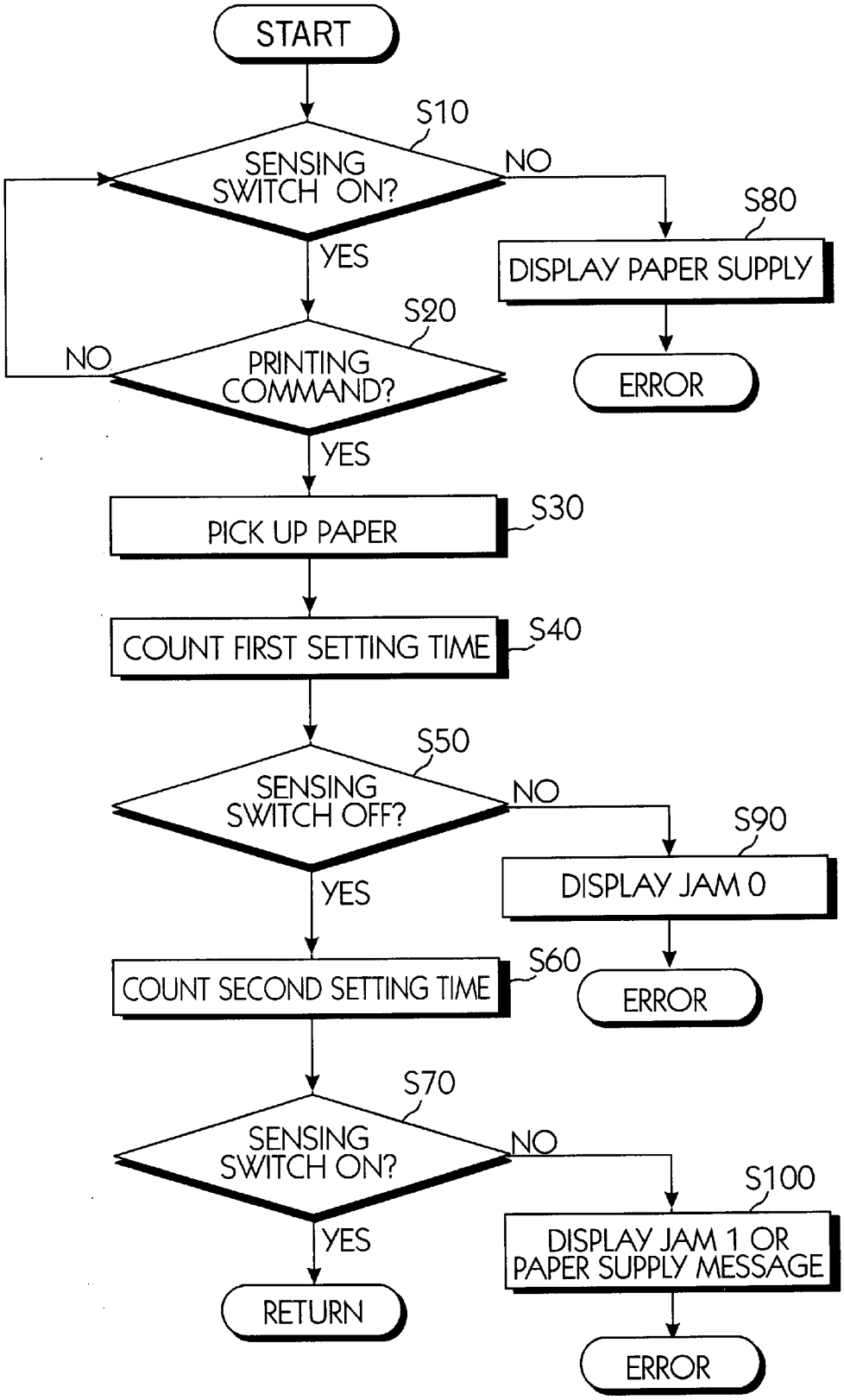
FIG. 5 is an operation flow chart of the paper detecting apparatus according to the present invention.

As shown in FIGS. 2, 3 and 4, in the interior of the electrophotographic processor, there is installed a sensor switch 10 at an optional location, but preferably on the side on the transport roller above the paper support, which is used for the purpose of sensing paper loading and paper transport state. The sensor switch 10 is provided with supply voltage B", and is the type that is off at normal times, but is turned on by contact with one end of the second actuator as described later on.

On the same line with the sensor switch and above the paper support there is hinged, on a hinge shaft 40, the bent section of an L shaped second actuator 30. Also, on the hinge shaft 40, one end of a first actuator 20 is hinged. Furthermore, the first and second actuators 20 and 30 are connected by a spring 50, and on the paper support 60, there is an aperture 61 into which one end of the first actuator 20 is inserted.

Here, the elastic force of the spring 50 is set within a range such that it allows controlling of the abutment state of the second actuator 30 end and the sensor switch 10 depending on whether the paper, that is loaded on the paper support 60, is loaded or not, and during paper transporting, such that it allows releasing of abutment between the second actuator 30 end and the sensor switch 10.

In the paper detecting apparatus there is provided a timer for counting the set time, and a control unit (CONT) which determines whether paper is loaded and the paper transport state according to the sensor switch signals and timer output values.

The operation and effects of the paper detecting apparatus composed as the above are described with reference to FIGS. 2, 3, 4 and 5.

When the paper sensing mode is initiated, the control unit (CONT) checks whether the sensor switch 10 is on or not (Step S10).

In step S10, if paper is loaded on the paper support 60, the end of the first actuator 20 is unable to be inserted into the aperture 61 of the paper support 60 and is positioned above the loaded paper (P), as shown in FIG. 3, the end of the second actuator 30 abuts the sensor switch 10, the sensor switch, which has been turned off, is consequently turned on, the on signal is inputted into the control unit (CONT), and when the on signal of the switch 10 is inputted, the control unit proceeds to step S20.

On the other hand, in the step S10, if paper is not loaded on the paper support 60, the end of the first actuator 20 is rotated clockwise from the position in FIG. 3 and is inserted into the aperture 61 of the paper support 60, as shown in FIG. 4, and the second actuator 30, which is connected by a coil spring 50, also is rotated clockwise such that the end thereof is spaced from the sensor switch 10 at a predetermined distance.

Therefore, the sensor switch 10 is turned off, and when the off state of the switch 10 is sensed, the control unit (CONT) determines that paper has not been loaded on the paper support 60 and indicates a paper supply message on a display window (Step S80).

In the step S10, if a print command is inputted when the sensor switch 10 is turned on (Step S20), the control unit (CONT) drives a pickup roller (not shown) and picks up paper loaded on the paper support 60 (Step S30), and activates the timer which counts a first set time from the initiation of paper pickup (Step S40).

In the above steps, the first set time is the duration of time taken for the front end of the paper to contact the second actuator 30 by being transported by the transport roller. The first set time is stored in the control unit (CONT).

After the first set time has lapsed, the control unit checks whether the sensor switch 10 is off or not (Step S50), and if the sensor switch is turned off, the control unit drives the timer, counts the second set time from the initiation of the sensor switch turn off (Step S60), and then proceeds to step S70. If the sensor switch 10 stays on, the control unit determines the paper to be jammed and displays JAM 0 on the display window (Step S90).

In the above steps, the second set time is the duration of time of the sensor switch 10 being off corresponding to the end of the second actuator 30 being rotated clockwise, as shown in the dotted lines, by the paper being transported. The second set time is stored in the control unit (CONT) as the first set time, and the action in which the second actuator is displaced by the transported paper is possible because the elastic force of the spring 50 is smaller than the force of the paper being transported.

After the second set time has lapsed, the control unit checks whether the sensor switch 10 is turned on or not (Step S70). If the sensor switch is turned on, the control unit returns to step S10, and if the sensor switch is turned off, the control unit displays JAM 1 or a paper supply error message on the display window (Step S100).

Although the sensing section has been composed of an on-off type switch in the embodiment, the sensing section may be composed of light sensors that are made up of light collecting elements and light emitting elements.

As discussed above, the paper detecting apparatus according to the present invention is able to sense both paper loading within the paper cassette and paper transporting within the electrophotographic processor through the use of only one sensor. Therefore, product cost reduction may be achieved.

It is to be understood, however, that even though the present invention has been described with reference to the annexed drawings which depict the preferred embodiment thereof, the present invention is not limited to the said embodiment, and may be modified in many ways by those of ordinary skill in the art without departing from the general principle and scope of the invention as expressed in the appended claims.

What is claimed is:

1. A paper detecting apparatus of an electrophotographic processor, comprising:

a first actuator having one end thereof hinged to hinge means for producing a displacement depending on whether paper is loaded on a paper support;

an L shaped second actuator having a center thereof hinged to said hinge means for producing a displacement depending on a paper transport state;

sensing means for outputting different signals according to an abutment state of said sensing means with an end of said second actuator;

elastic means for controlling the abutment state of said sensing means with said end of said second actuator according to a paper loading state, and for connecting said first actuator and said second actuator such that abutment between the end of said second actuator and said sensing means is released during paper transport;

a timer which measures time periods of the different signals outputted by said sensing means to produce output values; and a control unit which determines the paper loading state and the paper transport state according to the output values of said timer and an on/off state of said sensing means.

2. The paper detecting apparatus of claim 1, wherein said sensing means is off when said end of said second actuator is not abutting said sensing means.

3. The paper detecting apparatus of claim 2, wherein said paper support is provided with an aperture into which said one end of said first actuator is inserted when the paper is not loaded in said paper support.

4. The paper detecting apparatus of claim 2, wherein said control unit senses paper according to the steps of:

determining the paper loading state by checking whether said sensing means is on;

determining whether a print command has been inputted;

picking up the paper;

counting a first set time;

displaying a paper jam error message by checking whether said sensing means is off;

counting a second set time; and displaying a paper supply error message by checking whether said sensing means is on.

5. The paper detecting apparatus of claim 1, wherein said paper support is provided with an aperture into which said one end of said first actuator is inserted when the paper is not loaded in said paper support.

6. The paper detecting apparatus of claim 1, wherein said sensing means is off when said end of said second actuator is not abutting said sensing means.

7. The paper detecting apparatus of claim 1, wherein said control unit senses paper according to the steps of:

determining the paper loading state by checking whether said sensing means is on;

determining whether a print command has been inputted;

picking up the paper;

counting a first set time;

displaying a paper jam error message by checking whether said sensing means is off;

counting a second set time; and displaying a paper supply error message by checking whether said sensing means is on.

8. A paper detecting apparatus for an electrophotographic processor, comprising:

first actuator means having one end thereof hinged for producing a displacement depending on whether paper is loaded on a paper support;

second actuator means having a portion thereof hinged for producing a displacement depending on a paper transport state;

sensing means for outputting different signals according to an abutment state of said sensing means with an end of said second actuator means;

elastic means for controlling the abutment state of said sensing means with said end of said second actuator means according to a paper loading state, and for connecting said first actuator means and said second actuator means such that abutment between the end of said second actuator means and said sensing means is released during paper transport;

timer means for measuring time periods of the different signals outputted by said sensing means to produce output values; and control means for determining the paper loading state and the paper transport state according to the output values of said timer means.

9. The paper detecting apparatus of claim 8, wherein said sensing means comprises an on off switch which is off when said end of said second actuator means is not abutting said sensing means.

10. The paper detecting apparatus of claim 9, wherein said paper support is provided with an aperture into which said one end of said first actuator means is inserted when the paper is not loaded in said paper support.

11. The paper detecting apparatus of claim 9, wherein said control means senses paper by determining the paper loading state by checking whether said on-off switch is on, determining whether a print command has been inputted, picking up the paper, counting a first set time, displaying a paper jam error message when said on-off switch is off, counting a second set time, and displaying a paper supply error message when said on-off switch is on.

12. The paper detecting apparatus of claim 8, wherein said paper support is provided with an aperture into which said one end of said first actuator means is inserted when the paper is not loaded in said paper support.

13. The paper detecting apparatus of claim 8, wherein said sensor means comprises an on-off switch, and wherein said control means senses paper by determining the paper loading state by checking whether said on-off switch is on, determining whether a print command has been inputted, picking up the paper, counting a first set time, displaying a paper jam error message when said on-off switch is off, counting a second set time, and displaying a paper supply error message when said on-off switch is on.

14. The paper detecting apparatus of claim 8, wherein said second actuator means comprises an L-shaped actuator, and a center of said second actuator means is hinged to said one end of said first actuator means.

* * * * *